US007959023B2

(12) United States Patent
Ferrara

(10) Patent No.: US 7,959,023 B2
(45) Date of Patent: Jun. 14, 2011

(54) INTAKE TRACKING HYDRATION CONTAINER

(75) Inventor: Vincent R. Ferrara, Wellesley, MA (US)

(73) Assignee: Xenith, LLC, Lowell, MA (US)

( * ) Notice: Subject to any disclaimer, the term of this patent is extended or adjusted under 35 U.S.C. 154(b) by 433 days.

(21) Appl. No.: 12/124,243

(22) Filed: May 21, 2008

(65) Prior Publication Data

US 2009/0289026 A1 Nov. 26, 2009

(51) Int. Cl.
*B65D 51/00* (2006.01)
*B65D 23/00* (2006.01)
*B65D 85/00* (2006.01)

(52) U.S. Cl. ..... 215/230; 215/365; 206/459.5

(58) Field of Classification Search ..... 215/230, 215/311, 307, 329, 365; 220/254.9, 254.8, 220/254.1, 345.1, FOR. 203, FOR. 183, 303, 220/288; 222/562, 559, 553, 548, 568, 567, 222/566; 206/459.1, 459.5; D9/450, 449, D9/447, 435; 40/311, 299.01, 310; 116/307–315, 116/306

See application file for complete search history.

(56) References Cited

U.S. PATENT DOCUMENTS 2,528,259 A * 10/1950 Annunziata ..... 116/308
3,227,127 A * 1/1966 Gayle ..... 116/308
3,782,577 A * 1/1974 Levey ..... 215/206
3,960,713 A * 6/1976 Carey ..... 206/534
4,749,093 A * 6/1988 Trick ..... 215/220
4,906,395 A * 3/1990 Stoesser et al. ..... 510/100
5,009,338 A * 4/1991 Barker ..... 215/230
5,011,032 A * 4/1991 Rollman ..... 215/230
5,277,325 A * 1/1994 Yan ..... 215/206
5,558,227 A * 9/1996 Hakamada ..... 206/459.5
6,059,132 A * 5/2000 Benjamin ..... 215/206
6,523,688 B1 * 2/2003 Palmieri ..... 206/459.1
6,629,624 B2 * 10/2003 Stillinger et al. ..... 220/714
D490,707 S * 6/2004 Mataya ..... D9/436
6,789,497 B1 * 9/2004 Aiken ..... 116/308
D508,202 S * 8/2005 Dobson et al. ..... D9/447
2001/0050242 A1 * 12/2001 Kaplan ..... 206/534
2006/0180566 A1 * 8/2006 Mataya ..... 215/230
2009/0095645 A1 * 4/2009 Lopez ..... 206/217

* cited by examiner

*Primary Examiner* — Anthony Stashick
*Assistant Examiner* — Robert J Hicks
(74) *Attorney, Agent, or Firm* — Bingham McCutchen LLP

(57) ABSTRACT

A hydration container includes a bottle having a selected volume and a bottle cap which includes a drinking nozzle. An indicator bearing a sequence of numbers is moveably mounted to the cap so that any one of the numbers in the sequence may be positioned opposite an index on the cap. Preferably, the numbers on the indicator are coordinated with numbers in a recommended daily fluid intake table present on the bottle. Thus when the user increments or decrements the indicator each time the bottle is refilled with fluid, the container will indicate in real time the user's approximate actual fluid consumption versus the intake goal indicated by the table.

6 Claims, 2 Drawing Sheets

| | MALE | FEMALE |
|---|---|---|
| AGE | BOTTLES A DAY | BOTTLES A DAY |
| 1-3yr | 1 | 1 |
| 4-8yr | 1-2 | 1-2 |
| 9-13yr | 2-3 | 2-3 |
| 14-18yr | 3-4 | 3-4 |
| 19-21yr | 4 | 4 |
| 22-25yr | 6 | 5 |
| 26+yr | 6 | 6 |

INTAKE TRACKING HYDRATION CONTAINER

BACKGROUND OF THE INVENTION

1. Field of the Invention

This invention relates to fluid containers. It concerns especially a container for holding a hydration fluid, particularly drinking water.

2. Background Information

Containers of the type of interest here are often carried by bikers, hikers and other individuals engaged in strenuous physical activities. This is because those individuals lose a considerable amount of fluid during the course of those activities which must be replenished in order to avoid dehydration, electrolyte imbalance and the like.

Conventional hydration containers usually consist of a conveniently sized and shaped bottle having an open top and a cap that includes a drinking nozzle and which may be releasably secured to the top of the bottle to close that top opening. Most often, the nozzle in the cap is a so-called sport nozzle which includes a movable valve member. When the valve member is pulled up away from the cap, the contents of the bottle may flow out through the nozzle and when that member is pushed down towards the cap, fluid flow through the nozzle is blocked.

As indicated above, it is essential that each individual using the container consume enough beneficial fluid over the course of a day of physical exercise to prevent dehydration and other physical problems. Unfortunately, it is quite difficult for that individual, under stress, to keep track of the amount of fluid that he/she has consumed over time, i.e. the number of times the container has been refilled with fluid.

SUMMARY OF THE INVENTION

Accordingly, the present invention aims to provide a hydration container which apprises the user of the amount of fluid he/she has consumed from the container over time.

Another object of the invention is to provide a hydration container of this type which is easy to use.

A further object of the invention is to provide such a container which apprises the user of a recommended daily fluid intake.

Still another object of the invention is to provide a container which gives a fluid intake indication which is easy to see even though the user is running or engaged in other physical activity.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, the hydration container comprises a bottle having an open top which may be closed by a removable cap containing a drinking nozzle. The cap also includes an indicator preferably in the form of a dial, which is moveably mounted to the cap. The indicator carries a sequence of numbers and it may be moved relative to the cap to position one of those numbers opposite an index inscribed on the cap. Each of these numbers represents the number of times the bottle contents has been consumed by the user. Typically, these numbers would be 0, 1, 2, 3 . . . X, the value X depending upon the volume of the bottle and a body parameter as will be described.

Preferably also the container includes a recommended daily fluid intake table inscribed on the bottle. This table lists the number of bottles that should be consumed over a period of time, e.g. a day, based on a selected body parameter, such as age, weight or the like. At the beginning of a day or before the start of a race or other event, the user may fill the container and position the indicator so that the number 0 is located opposite the index. As the day or event proceeds, the user may drink from the container until it is empty, at which time the bottle is refilled and the indicator advanced so that the number 1 is positioned opposite the index. During the course of the day or event, the user may consume the contents of the bottle several times, advancing the indicator in each case. Thus, at any given time, the number opposite the index on the container cap immediately tells the user how many bottles of water or other fluid he/she has consumed up to that time. The user may compare that number to the recommended daily intake number in the table on the bottle. Thus, the user can tell at any given time whether he/she should drink more or less water during the rest of the day or the remainder of the event.

Of course, instead of setting the indicator to 0 at the beginning of the event, the user may position an indicator number opposite the index which corresponds to the recommended daily intake number from the table and move the indicator in the opposite direction each time the bottle contents is consumed, in which case, the container will show the number of bottles left to be consumed before the user satisfies that requirement. When the bottle is empty and the indicator is moved to position 0 opposite the index, the user knows to stop drinking from the container.

BRIEF DESCRIPTION OF THE DRAWINGS

For a fuller understanding of the nature and objects of the invention, reference should be made to the following detailed description taken in connection with the accompanying drawings, in which.

DESCRIPTION OF A PREFERRED EMBODIMENT

Figure 1:
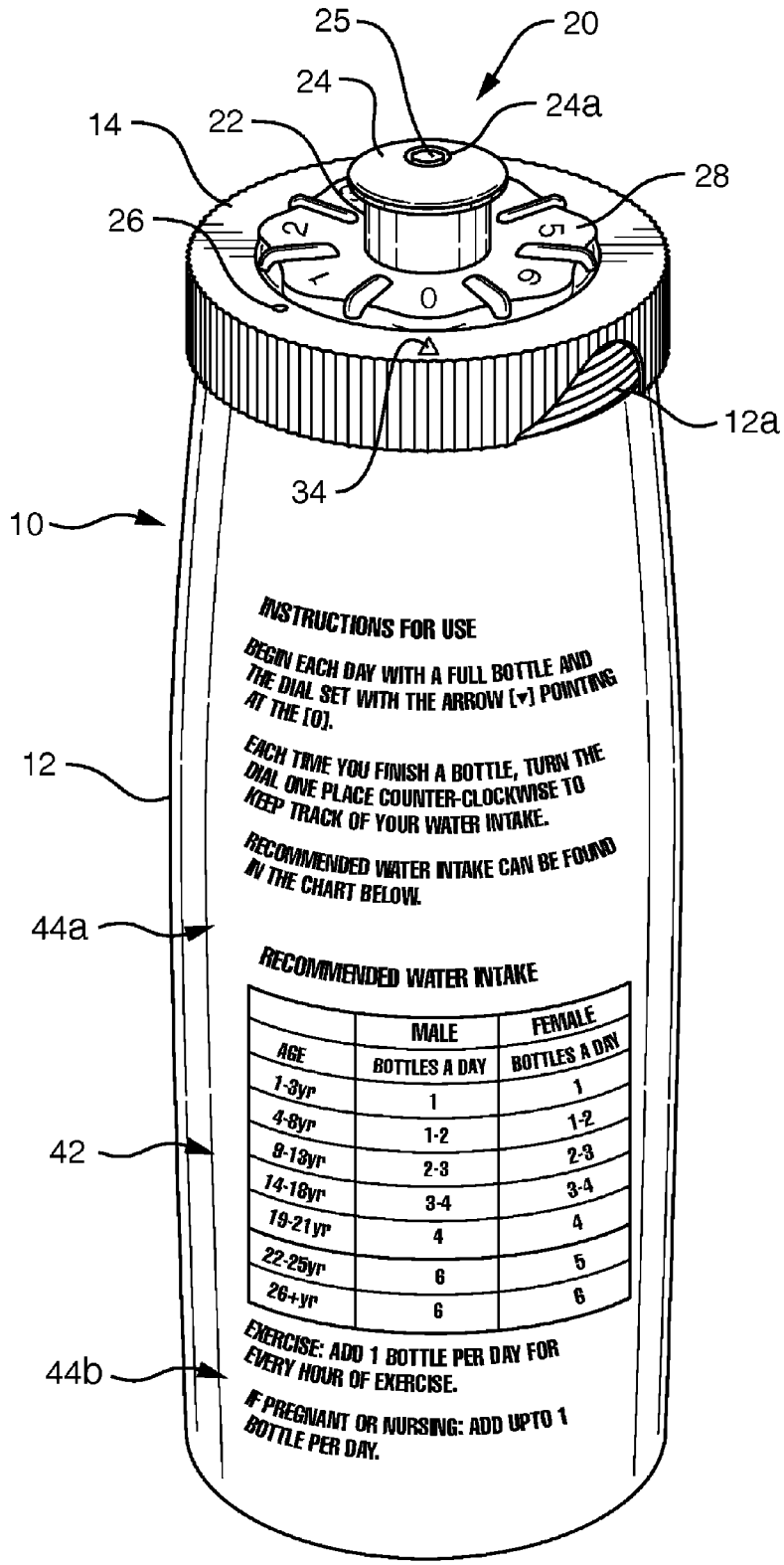
FIG. 1 is an isometric view of an intake tracking hydration container according to my invention.
Figure 2:
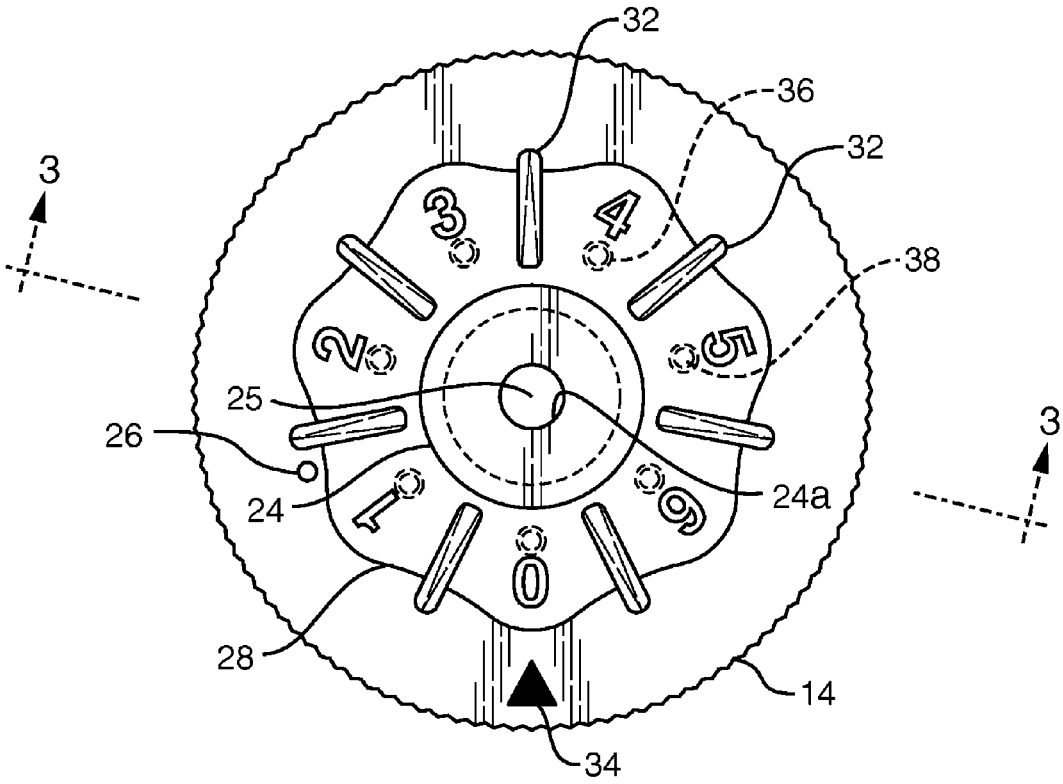
FIG. 2 is a top plan view on a larger scale thereof.
Figure 3:
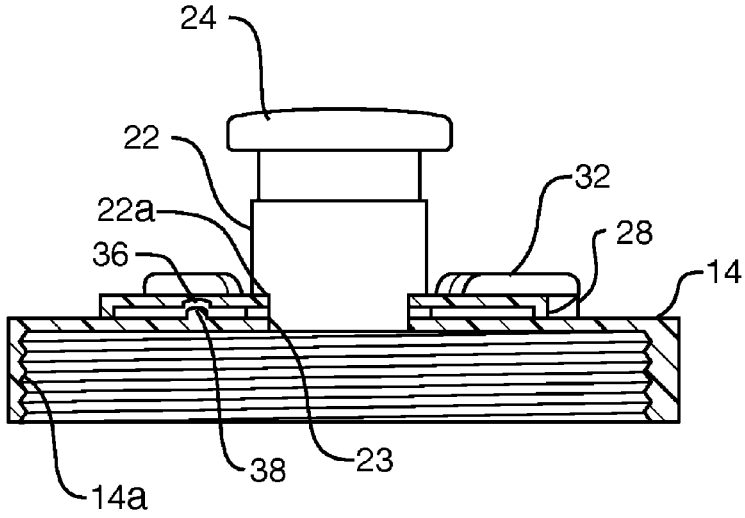
FIG. 3 is a sectional view taken along line 3-3 of FIG. 2.

Referring to FIGS. 1 to 3 of the drawings, the present hydration container, indicated generally at 10, comprises an open top bottle 12 which is preferably of an impact resistant plastic material, and a cap 14 which may be releasably secured to the top of the bottle. For example, cap 14 may have interior threads 14*a* that mate with exterior threads 12*a* at the top of the bottle so that the cap can be screwed onto the bottle to close the top opening thereof.

Cap 14 includes a drinking nozzle shown generally at 20. Preferably, nozzle 20 is a conventional so-called sport nozzle which includes an outer sleeve 22 whose lower end is inserted into a central opening 23 in the top of cap 14 and secured to the edge of the hole by a weld, adhesive or the like. Nozzle 20 also has a valve member 24 which is slidably positioned in sleeve 22. When valve member 24 is moved up vertically to an open position in sleeve 22, fluid can flow from the interior of bottle 12 to an opening 24*a* at the top of valve member 24. On the other hand, when the valve member is pressed down to a closed position within sleeve 22, fluid flowing through the opening 24*a* is blocked by a post 25 as is well known in the art. A conventional vent hole 26 is provided in the top of cap 14 to avoid a vacuum lock which would prevent free flow of fluid from bottle 12 when nozzle 20 is open.

As shown in FIGS. 1-3, cap 14 also includes an indicator 28 moveably mounted to the top of the cap. While the indicator member may take a variety of forms, in the illustrated container embodiment, indicator 28 is in a form of an annular rotatable dial which encircles sleeve 22. The indicator is held in place by a shoulder 22*a* of sleeve 22 which overlies the inner edge margin of the indicator.

As best seen in FIGS. 2 and 3, the upper surface of indicator 28 is divided into a plurality of equal sectors by raised ribs 32 and the areas between those ribs are numbered sequentially. The illustrated indicator carries the numbers 0 (start) to 6. In another preferred embodiment, a symbol, such as a star, may be used instead of the "0". Thus, by rotating indicator 28 using ribs 32, any one of those numbers may be positioned opposite an index 34 inscribed in the top of cap 14.

Preferably, detents are provided to releasably retain indicator 28 when each numbered sector of the indicator is opposite index 34. Thus, in the illustrated embodiment, the underside of indicator 28 is formed with a circular array of dimples 36, each dimple being positioned more or less in the middle of a numbered sector of the indicator. Also at least one bump 38, or more preferably, a plurality of such bumps are present on the upper surface of cap 14 under indicator 28. The dimple(s) and bump(s) are in register when one of the numbers 0-6 on the indicator is directly opposite index 34. When the indicator 28 is rotated, the indicator will flex upward enough to allow the bump(s) 38 to slide along the underside of indicator 28 until the bump(s) is/are in vertical alignment with the dimple(s) when a numbered sector of the indicator 28 is opposite index 34 at which point each bump on cap 14 will resiliently engage in an opposite dimple in indicator 28.

Of course, this is only one of many possible ways to releasably locate the numbered sectors of the indicator opposite index 34.

When a user drinks from container 10, the container itself will help the user keep track of the amount of fluid he/she has consumed. More particularly, at the beginning of a day or event, the user may fill container 10 and set indicator 28 to position the number 0 opposite index 34. During the course of the event, each time the user consumes the contents of bottle 12, he/she will advance the indicator to a position the next number opposite index 34. Since the bottle 12 has a known volume, e.g. 750 mL., by looking at the top of the container, the user will know immediately the number of bottles, and thus approximate amount of fluid, he or she has consumed up to that point in time. For example, if the indicator is set on the number 3, the user knows that he/she has consumed three bottles of fluid and is working on the fourth. Knowing the volume of the bottle 12, the user can tell immediately whether or not he/she is meeting the recommended fluid requirement.

Of course, instead of initially setting indicator 28 to 0, it could be set to a selected number indicating a desired volumetric intake goal, e.g. 5. The user may then rotate the indicator in the opposite direction to decrement the indicator each time he/she refills the bottle 12. In that event, the container will indicate the number of bottles left to drink by the end of the day/event in order to satisfy the recommended fluid intake requirement.

When container 10 is used primarily as a water bottle, in order to further assist the user, the container may include a recommended water intake table 42 inscribed on bottle 12 as shown in FIG. 1. The bottle may also carry various instructions for using the table as indicated at 44*a* and 44*b*.

As shown in FIG. 1, table 42 may, for example, list the numbers of bottles that should be consumed in a day for males and females, based on their ages. Other body parameters may be used in the table, e.g. weight, height, etc. Also, the numbers should be based on the volume of the particular bottle 12, e.g. 750 mL. Of course, if the bottle 12 volume is more or less than that value, the bottle numbers in the table would be correspondingly lower or higher. In any event, the bottle numbers in the table should correspond to the numbers on indicator 28.

Thus, if the user of container 10 is a 14 year old male, table 42 tells him that his recommended water intake is 2-3 bottles. Therefore, when filling container 10 for the first time, the user may set the indicator 28 to 0. Then, each time the container is refilled, the indicator should be advanced so that at any given time during the day, by looking at the number opposite index 34 and comparing it to table 42, the user will know whether or not he is on track to consume the recommended 2-3 bottles of water.

It is apparent from the foregoing that container 10 is composed of relatively simple, molded plastic parts that can be made in quantity quite inexpensively. Therefore, the incorporation of my invention into an otherwise more or less standard hydration container does not add appreciably to the overall cost of that container. Therefore, the container should prove to be a very marketable consumer item.

It will thus be seen that the objects set forth above among those made apparent from the preceding description are efficiently attained and, since certain changes may be made in the above construction without departing from the scope of the invention, it is intended that all matter contained in the above description as shown or the accompanying drawings shall be interpreted as illustrative and not in a limiting sense.

It is also to be understood that the following claims are intended to cover all the generic and specific features of the invention described herein.

I claim:

1. A hydration container comprising a bottle having a bottom wall, a side wall, an open top and able to hold a selected volumetric content; a cap, said cap including a drinking nozzle, a coupling for coupling the cap to the bottle to close an opening therein, an index inscribed on the cap, and an indicator bearing a sequence of numbers;

a device for moveably mounting the indicator to the cap so that any one of the numbers in said sequence may be positioned opposite the index, and a table on the side wall of the bottle, said table including a first list of numbers corresponding to the numbers in the sequence of numbers on the indicator and juxtaposed to a second list of numbers related to a selected body parameter whereby a user may move the indicator to index a selected number on the cap and, using a corresponding number in said first list and a selected number from the second list, determine what multiple of said contents has been or should be consumed.

2. The container defined in claim 1 wherein the indicator comprises a moveable dial and said sequence of numbers is inscribed on the dial.

3. The container defined in claim 2 wherein the dial comprises an annulus which encircles said drinking nozzle and is rotatably mounted thereto and the numbers in said sequence of numbers are inscribed in different sectors of the annulus.

4. The container defined in claim 3 and further including one or more ribs projecting from the dial to facilitate the rotation thereof.

5. The container defined in claim 3 and further including coacting detents on the opposing surfaces of said dial and said cap for releasably retaining the dial when any number in said sequence of numbers is positioned opposite the index, while permitting the dial and cap to rotate relatively in both directions.

6. The container defined in claim 2 wherein the drinking nozzle is a sport nozzle including a valve.

* * * * *